US007836835B2

(12) United States Patent
Feger

(10) Patent No.: US 7,836,835 B2
(45) Date of Patent: Nov. 23, 2010

(54) GAS INCINERATOR INSTALLED ON A LIQUEFIED GAS TANKER SHIP OR A LIQUEFIED GAS TERMINAL

(75) Inventor: Damien Feger, Vernon (FR)

(73) Assignee: SNECMA, Paris (FR)

( * ) Notice: Subject to any disclaimer, the term of this patent is extended or adjusted under 35 U.S.C. 154(b) by 1286 days.

(21) Appl. No.: 11/334,291

(22) Filed: Jan. 18, 2006

(65) Prior Publication Data

US 2006/0166152 A1 Jul. 27, 2006

(30) Foreign Application Priority Data

Jan. 21, 2005 (FR) ..... 05 00631

(51) Int. Cl.
*F23B 10/00* (2006.01)

(52) U.S. Cl. ..... 110/214; 110/203; 110/210; 110/215; 110/345; 110/348; 431/12

(58) Field of Classification Search ..... 110/214, 110/215, 203, 205, 216, 345, 210, 346, 348; 137/101.11, 112, 14, 214, 247.17, 247.29, 137/51, 602, 625.28, 625.4, 834, 89; 431/12; 588/321, 312

See application file for complete search history.

(56) References Cited

U.S. PATENT DOCUMENTS 1,629,251 A * 5/1927 Blake ..... 431/60
2,702,590 A * 2/1955 Stillman ..... 431/9
2,837,893 A * 6/1958 Schirmer ..... 60/39.23
2,979,124 A * 4/1961 Kirk ..... 236/9 R
3,057,983 A * 10/1962 Yeckley et al. ..... 218/4
3,164,201 A * 1/1965 Irwin ..... 236/14
3,548,761 A * 12/1970 Zalman ..... 110/187
3,797,989 A * 3/1974 Gordon ..... 431/90
3,824,069 A * 7/1974 Brachthauser et al. ..... 432/80
3,892,519 A 7/1975 Reed et al.
3,914,090 A * 10/1975 Pfefferle ..... 431/9
4,137,036 A 1/1979 Straitz, III
4,181,491 A * 1/1980 Hovis ..... 431/187
4,438,706 A * 3/1984 Boday et al. ..... 588/311
4,439,274 A * 3/1984 Goossens et al. ..... 201/41
4,509,434 A * 4/1985 Boday et al. ..... 110/238

(Continued)

FOREIGN PATENT DOCUMENTS

DE 102 11 645 10/2003

(Continued)

*Primary Examiner*—Kenneth B Rinehart
*Assistant Examiner*—Jorge Pereiro
(74) *Attorney, Agent, or Firm*—Weingarten, Schurgin, Gagnebin & Lebovici LLP

(57) ABSTRACT

The invention relates to a gas incinerator device comprising a combustion chamber having a heater body producing combustion gas, at least one fan feeding the heater body with cool air to ensure combustion, and an exhaust chimney for exhausting the mixture formed by the combustion gas and the cool air, the combustion chamber being mounted in the exhaust chimney in such a manner as to leave an annular duct between the combustion chamber and the exhaust chimney to pass a flow of combustion cool air and/or of cooling air coming from said at least one fan, said combustion chamber having a plurality of injection orifices and/or tubes enabling a fraction of the cool air flowing in the annular duct to be injected therein.

12 Claims, 3 Drawing Sheets

U.S. PATENT DOCUMENTS 4,552,082 A * 11/1985 Grey ..... 588/321
4,632,042 A * 12/1986 Chang ..... 110/243
4,819,438 A * 4/1989 Schultz ..... 60/730
4,981,088 A * 1/1991 Burris ..... 110/193
5,018,547 A * 5/1991 Alcorn ..... 137/111
5,156,097 A * 10/1992 Booth et al. ..... 110/214
5,269,236 A * 12/1993 Okuno et al. ..... 110/297
5,322,026 A * 6/1994 Bay ..... 110/235
5,397,551 A * 3/1995 Won Sam ..... 422/186
5,820,736 A * 10/1998 Bouziane et al. ..... 202/136
5,937,539 A * 8/1999 Takahashi ..... 34/191
6,135,063 A * 10/2000 Welden ..... 122/446
6,293,121 B1 * 9/2001 Labrador ..... 62/304
6,485,292 B1 11/2002 Rhodes et al.
6,517,770 B1 * 2/2003 Tateishi et al. ..... 266/46
6,782,906 B2 * 8/2004 Chang ..... 137/10
6,810,897 B2 * 11/2004 Girard et al. ..... 137/2
2003/0059731 A1 3/2003 Coffey et al.
2005/0058959 A1 * 3/2005 Fortin et al. ..... 431/12

FOREIGN PATENT DOCUMENTS

JP 2001269530 A * 10/2001
WO WO 01/09547 2/2001

* cited by examiner

GAS INCINERATOR INSTALLED ON A LIQUEFIED GAS TANKER SHIP OR A LIQUEFIED GAS TERMINAL

This application claims priority to a French application No. 05000631 filed Jan. 21, 2005.

FIELD OF THE INVENTION

The present invention relates to the general field of gas incinerators and it relates more particularly to a gas incinerator device installed on a liquefied gas tanker ship or a liquefied gas terminal.

BACKGROUND OF THE INVENTION

In general, a liquefied gas tanker ship, e.g. for conveying petroleum or natural gas, comprises tanks for storing the liquefied gas at atmospheric pressure and at a temperature of about −160° C. Although the tanks containing the cargo are insulated, a fraction of the cargo evaporates on a continuous basis, typically of the order of 0.1% to 0.3% per day, because of the heat that penetrates through the insulation.

While the tanker is under way, the liquefied gas vapor is advantageously used as fuel for propelling the ship. When the liquefied gas vapor is not used for propulsion purposes, or when there is an excess of such vapor, regulations require the excess gas to be eliminated by being burnt, or else by being reliquefied, since any dumping of the liquefied gas vapor directly into the atmosphere is prohibited.

Installing a reliquefier on board the ship is generally very complex and expensive, so the solution that is implemented in most circumstances has therefore been to burn off the excess gas vapor. It is therefore necessary to have on board the ship means for incinerating the gas in complete safety, in particular without allowing a bare flame to appear, while also exhausting combustion gas at a temperature of less than about 450° C., as permitted by the regulations in force.

To satisfy these constraints, liquefied gas tanker ships have until now been fitted with a steam turbine propulsion system in which the liquefied gas vapor is burnt in the boiler of the propulsion system. The steam produced by the boiler is directed either directly to the turbine for propelling the ship or else to a steam/water condenser, assuming that the amount of steam exceeds the energy requirements of the ship. Under such circumstances, the boiler serves simultaneously as a steam generator for the propulsion system and as an incinerator of excess liquefied gas vapor when the ship's energy requirements are small.

Unfortunately, that type of steam turbine propulsion for liquefied gas tanker ships nevertheless suffers from major drawbacks, and in particular:

- low efficiency, in particular efficiency that is lower than gas diesel propulsion systems, gas turbine systems, or even slow or heavy diesel fuel systems;
- large size, diminishing the volume available for the cargo, for given volume of ship's hull; and
- unusual propulsion technology, which can lead to difficulties of maintenance and of crew training.

That type of propulsion is thus being replaced at present by diesel engine propulsion systems burning gas, by gas turbines, or by diesel engines operating on heavy fuel. Unfortunately, those propulsion systems cannot be used for incinerating excess liquefied gas vapor. It is therefore necessary to associate them with a specific device for incinerating such gas.

Even with slow diesel engines that do not use natural gas vapor as fuel and that are generally coupled to a reliquefier, one or more incinerators are still required by classification companies in order to perform two functions: the first function relates to eliminating the nitrogen-rich portion of the natural gas vapor that it is not economically viable to reliquefy; and the second function relates to eliminating all of the vapor when the reliquefier(s) is/are out of order.

Thus, even for ships that do not use steam propulsion that can burn the vapor escaping from the tanks, classification companies still require an additional device for incinerating the vapor.

FIG. 3 is a highly diagrammatic view of a prior art on-board device 101 for incinerating gas or vapor.

The device 101 comprises a combustion chamber 103 and a chimney 111. The combustion chamber 103 comprises a heater body 105 having one or more burners 147 placed in the enclosure of the combustion chamber 103 which is generally of dimensions larger than those of the chimney 111. Thus, the combustion chamber 103 is connected to the chimney 111 by a connection piece 116 via a flexible coupling 108 for compensating the effects of expansion.

In order to bring the temperature of the gas 113 at the outlet from the chimney 111 to an acceptable temperature, the combustion chamber 103 is fed with excess air so that the hot gas from the flames 131 of the burners 147 is mixed with cool air. This cool combustion-and-dilution air is forced into the combustion chamber 103 by fans 107*a*, 107*b* driven by motors 113*a*, 113*b*.

In order to force mixing between the hot gas and the cool air, turbulators 135 are optionally placed in the combustion chamber 103 or in the chimney 111. These turbulators 135 need to be made of refractory materials, e.g. refractory steels or bricks that are expensive to purchase and to maintain.

The use of ambient air for simultaneously ensuring combustion and dilution can sometimes lead to considering separating these two functions by means of two series of fans. A first series of fans 107*a* and 107*b* is dedicated mainly to supplying combustion air, while a second series of fans 108 driven by motors 114 is dedicated to supplying dilution air. The injection point of the cool air delivered by these fans 108 is generally located in the high portion of the combustion chamber 103 thus making it possible, amongst other things, to reduce head losses.

The burners 147 are ignited by pilot flames 132 fed by a separate circuit for gas or fuel oil. This leads to extra expense, both at purchase and during maintenance, and the use of an additional fuel can lead to a fire hazard. The pilot flames 132 are themselves ignited by electrical spark plugs 171.

A diaphragm 151 is optionally placed level with the burners 147 to optimize the distribution of air around them and to generate turbulence for "catching" the flames 131.

In order to avoid, amongst other things, any risk of the crew suffering burns, the combustion chamber 103 and the chimney 111 are lined with thermal insulation 104 either on the inside or on the outside.

For safety reasons, the line 157 feeding gas to the burners 147 is fitted with two cut-off valves 161 and 163 which can be caused to close in the event of flames 131 not being detected at the burners 147. In addition, in order to satisfy safety essentials, a third valve 173 is placed to direct any gas that is trapped between these two valves 161 and 163 to the vent.

The flow rate of the gas sent to the incinerator 101 for being treated therein is usually controlled by a regulator valve 159.

In order to handle transients in the gas line 157, e.g. when changing the operating speed of the engines or of a reliquefier, a buffer tank 181 can optionally be placed upstream from the valves 159, 161, and 163. The buffer tank 181 serves to damp pressure variations in the gas line 157, making it possible, for example, to launch the sequence of igniting the incinerator 101 before being able to open the valves 159, 161, and 163 in order to burn off the excess gas in the gas line 157.

The buffer tank 181 operates between a minimum pressure and a maximum pressure for the line feeding the engines or the reliquefier, and that constitutes a relatively small range of pressures, of the order of a few hundreds of kilopascals (kPa). The buffer tank 181 must therefore have very considerable volume, typically several tens of cubic meters ($m^3$), thus presenting a factor of cost and of bulk.

In addition to burning off the natural gas vapor coming from the tanks of a ship that is not consumed by the propulsion system, or that is not reliquefied by the reliquefier, the incinerators on board methane tankers are also used during maintenance operations for eliminating mixtures of natural gas and inert gas.

When maintenance operations are necessary inside the tanks, the natural gas they contain must be replaced initially by an inert gas and then by air.

After emptying out the last of the liquefied natural gas cargo, the tanks still full of natural gas vapor are initially heated progressively by causing a portion of the gas to circulate in a closed circuit through heat exchangers. In order to maintain a constant pressure in the tanks during this heating operation, a fraction of the vapor is burnt off in the ship's propulsion system or by the incinerator 101.

Once the temperature in the tanks is close to ambient temperature, a mixture of nitrogen and carbon dioxide gas supplied by the inert gas generator of the ship is injected into the tanks to expel the natural gas vapor. The mixture of natural gas vapor and of inert gas is evacuated to the incinerator 101 in order to be burnt therein. Since the methane content of this mixture can be low, particularly towards the end of the operation, the auxiliary support flames (pilot flames 132), generally burning a different fuel such as fuel oil, are used to ensure that the mixture burns, thus increasing the risk of fire.

Furthermore, patent DE10211645 describes a gas incinerator installed on a ship and having two combustion chambers and a chimney. The combustion chambers are fed with combustion air via radial fans or blowers and with dilution air via radial fans. The connection between the combustion chambers and the chimney is located at the outlet from said combustion chambers and is therefore at the same temperature as the hot gas evacuated by the chimney, thereby running the risk, in the event of rupture, of hot gas leaking into the premises where the incinerator is located.

Furthermore, in addition to the risk of hot gas leaking, the incinerator devices of the prior art present several other drawbacks.

Such devices are bulky and present high levels of head loss, requiring fans and motors of significant power.

OBJECT AND SUMMARY OF THE INVENTION

The present invention thus seeks to mitigate the abovementioned drawbacks with a gas incinerator device presenting little bulk and being easy to install on a liquefied gas tanker ship or on a gas terminal of the off-shore type.

Another object of the invention is to simplify the architecture of the incinerator device in order to improve reliability and safety, and in order to facilitate maintenance and reduce costs.

These objects are achieved by a gas incinerator device comprising a combustion chamber having a heater body producing combustion gas, at least one fan feeding the heater body with cool air to ensure combustion, and an exhaust chimney for exhausting the mixture formed by the combustion gas and the cool air, wherein the combustion chamber is mounted in the exhaust chimney in such a manner as to leave an annular duct between the combustion chamber and the exhaust chimney to pass a flow of combustion cool air and/or of cooling air coming from said at least one fan, said combustion chamber having a plurality of injection orifices and/or tubes enabling a fraction of the cool air flowing in the annular duct to be injected therein.

Thus, no connection is needed and there is no need to have a matching piece and a flexible coupling between the combustion chamber and the chimney. This increases safety by eliminating any risk of hot gas leaking through the coupling and also reduces costs and head losses.

In addition, this simplifies the interfaces between the manufacturer of the incinerator (supplier of the combustion chamber) and the shipbuilder (where the exhaust chimney is built), thus reducing hazards and costs.

The exhaust chimney can be secured to a first support and the combustion chamber can be secured to a second support.

In a variant, the exhaust chimney is secured to a first support and the combustion chamber is suspended in the exhaust chimney by suspension means that are cooled by the air flowing in the annular duct.

Advantageously, the combustion chamber has a plurality of injection orifices and/or tubes enabling a fraction of the cool air that flows in the annular duct to be injected therein.

In an aspect of the invention, the device has a plurality of tubes disposed above the combustion chamber, bringing in additional cool air from the outside by a suction effect created by the cool air coming from said at least one fan.

Advantageously, the device includes a turbulator to facilitate mixing between the cool air and the combustion gas, said turbulator being mounted on some of said plurality of tubes.

In another aspect of the invention, the device includes at least a first water circuit having a first spray nozzle at its end that is received inside at least one tube of said plurality of tubes, the first spray nozzle injecting water into the mixture of combustion gas and cool air.

According to yet another aspect of the invention, the device includes an additional duct mounted around a top portion of the exhaust chimney and entraining an additional flow of ambient air by a suction effect.

The device may include at least one second water circuit having a second spray nozzle at its end received inside said additional duct.

According to a feature of the invention, the heater body is fed with gas independently by a main circuit presenting a high flow rate and by a secondary circuit presenting a low flow rate, the main and secondary circuits being connected to a gas line.

The main circuit may be controlled by first and second valves which are closed under the control of a pressure detector in the event of said at least one fan failing or by a flame detector if ignition does not occur.

The secondary circuit can be controlled by third and fourth valves that are closed under the control of the pressure detector in the event of said at least one fan failing.

Advantageously, the device includes a buffer tank put into connection either with the gas line by means of fifth and sixth valves for controlling the pressure therein, or else with the heater body by means of third, fourth, and fifth valves in order to be depressurized.

The invention also provides a tanker ship having liquefied gas tanks and including an incinerator device having the above characteristics.

The invention also provides a gas terminal including an incinerator device having the above characteristics.

BRIEF DESCRIPTION OF THE DRAWINGS

Other features and advantages of the incinerator device, ship, and gas terminal of the invention appear on reading the following description given by way of non-limiting indication and made with reference to the accompanying drawings, in which.

DETAILED DESCRIPTION OF EMBODIMENTS

Figure 1:
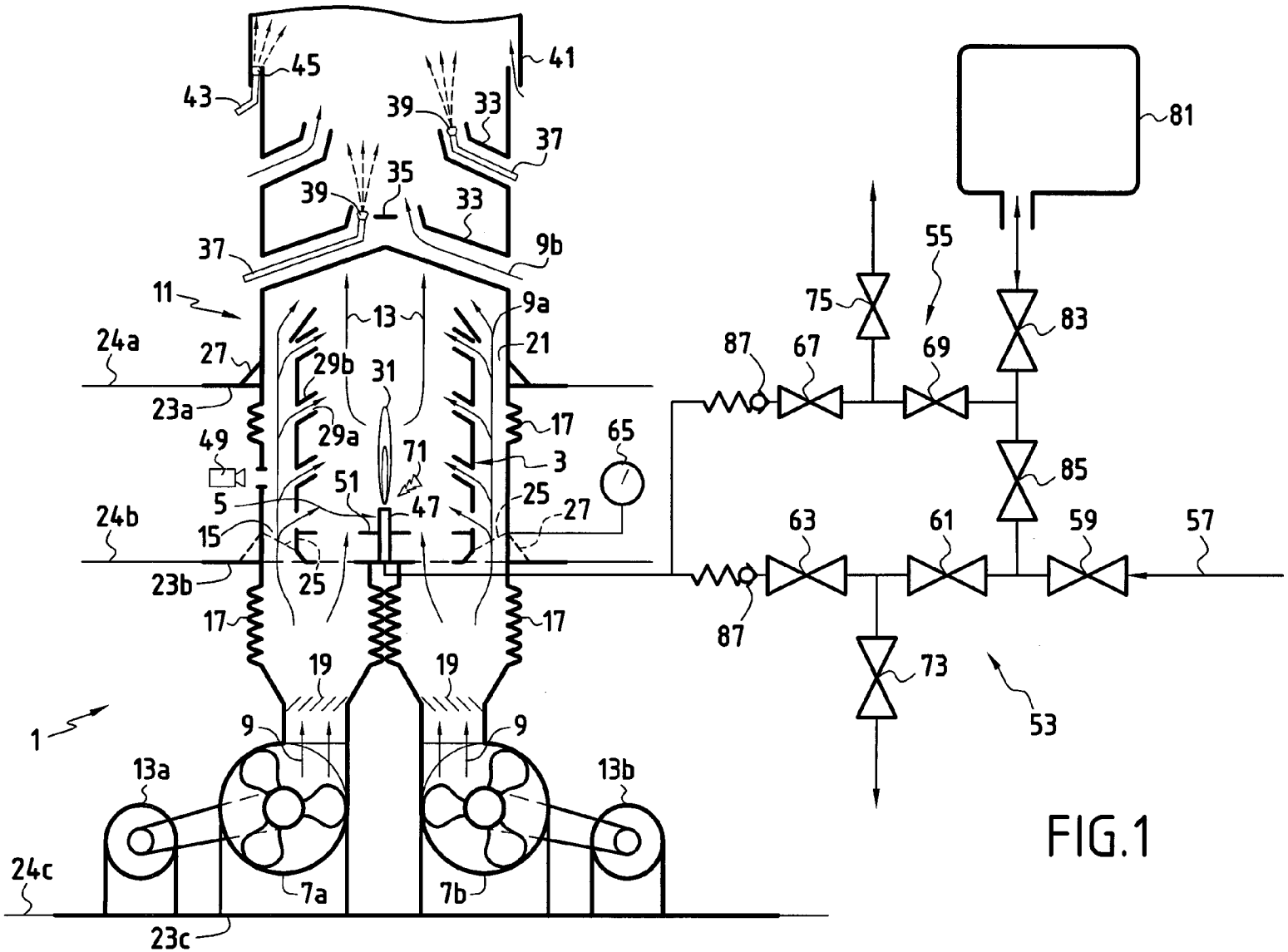
FIG. 1 is a highly diagrammatic view of a gas incinerator device of the invention.

In accordance with the invention, FIG. 1 is a highly diagrammatic view of a gas incinerator device 1 suitable for being installed on board a liquefied gas tanker ship or on an off-shore gas type terminal. The incinerator device 1 comprises a single combustion chamber 3 having a heater body 5 producing combustion gas, at least one fan 7*a*, 7*b* feeding the heater body 5 with cool air 9 in order to ensure combustion, and an exhaust chimney 11 for exhausting the mixture 13 of combustion gas and cool air 9.

In the example of FIG. 1, the incinerator device 1 has two fans 7*a* and 7*b* below and on the axis of the combustion chamber 3. The fans 7*a* and 7*b* may be driven by two motors 13*a* and 13*b*. The cool air 9 coming from the fans 7*a*, 7*b* is forced into the combustion chamber 3 via an air box 15. In order to make assembly operations easier and in order to reduce the transmission of vibration, the air box 15 is connected to the fans 7*a* and 7*b* and to the exhaust chimney 11 via flexible sleeves 17.

In order to make partial operation possible in the event of one of the fans 7*a* or 7*b* failing, check valves 19 are optionally located at the outlet from the fans 7*a*, 7*b* so as to guide all of the cool air blown in by the fan(s) 7*a*, 7*b* in operation towards the combustion chamber 3.

In accordance with the invention, the combustion chamber 3 is mounted in the exhaust chimney 11 in such a manner as to leave an annular duct 21 between the combustion chamber 3 and the exhaust chimney 11 to convey a flow of combustion cool air 9*a* and/or of cooling air coming from the fan(s) 7*a*, 7*b*. The combustion chamber surrounding the heater body 5 has a plurality of injection tubes 29*b* and/or orifices 29*a* enabling a fraction of the cool air 9*a* flowing in the annular duct 11 close to the flame 31 of the heater body 5 to be injected therein, thereby mixing said cool air with the combustion gas. In other words, the injection tubes 29*b* and the orifices 29*a* inject the cool air directly into the hot flow, thus mixing said cool air 9*a* with the hot flow. It should be observed that using the same fans for feeding the annular duct 21 and the inside of the combustion chamber 3 simplifies and reduces the cost and the electricity consumption of the installation.

The combustion chamber 3 is preferably given the same geometrical shape as the exhaust chimney 11 (e.g. a cylindrical shape), and it is inserted directly in the bottom portion thereof. This makes it possible, amongst other things, to eliminate any high-temperature coupling-and-adapter piece between the combustion chamber 3 and the exhaust chimney 11. In addition, the annular duct 21 presents mechanical clearance making it easier to insert and to install the combustion chamber 3 in the exhaust chimney 11.

In this example, the chimney 11 is connected in the annular space 21 via a compensator including the flexible sleeves 17. Thus, the connection can take place via a compensator operating at a temperature close to ambient (typically lower than 100° C.), thereby making it possible to use means that are inexpensive such as reinforced sheet-metal bellows. In addition, this presents little risk in the event of leakage, since the leak will be constituted by air that is likewise close to ambient temperature.

Furthermore, this simplifies the interfaces between the manufacturer of the incinerator and the shipbuilder who generally supplies the exhaust chimney 11. The annular duct or space 21 between the combustion chamber 3 and the exhaust chimney 11 is used both as a duct for conveying a fraction of the dilution air 9 towards the top of the combustion chamber 3, and as a heat shield enabling the walls of the bottom portion of the exhaust chimney 11 to be maintained at a temperature that is not dangerous for a ship's crew or personnel, but without it being necessary to have recourse to expensive and bulky insulation.

The cool air 9*a* flowing in the annular duct 21 also serves to cool the walls of the combustion chamber 3, thus making it possible to use inexpensive materials for making it that do not need to be protected by special thermal insulation.

Thus, the combustion chamber 3 is fed with dilution air and combustion air from below, and also with additional dilution air through its periphery via the annular duct 21.

Since all of the air (both combustion air and dilution air) delivered by the fans 7*a*, 7*b* passes through the combustion chamber 3 or flows over its periphery prior to passing into the injection tubes or orifices 29*b*, 29*a*, it is possible to make use of materials that are not refractory.

By way of example, when the gas incinerator device 1 is on board a ship (see also FIG. 2), the exhaust chimney 11 can be supported or secured to a first support 23*a* at an upper deck 24*a* of the ship. Nevertheless, the combustion chamber 3, the heater body 5, and the air box 15 can be secured to a second support 23*b* at an intermediate deck 24*b* of the ship, while the fans 7*a* and 7*b* can be secured to a third support 23*c* at a lower deck 24*c*. By this configuration, the chimney 11 supplied by the shipbuilder is supported independently of the combustion chamber 3, the heater body 5, and air box 15, and the fans 7*a*, 7*b*, all of which are pieces of equipment supplied by the manufacturer of the incinerator, thereby simplifying the mechanical interfaces between the shipbuilder and the equipment manufacturer.

It should be observed that since the exhaust chimney 11 is secured on the first support 23*a*, it goes down far enough around the combustion chamber 3 to ensure that the flexible connection 17 connecting it to the air box 15 and to the combustion chamber 3 that is mechanically connected to the support 23*b* is not exposed to the hot gas 13, but rather to the flow of cool air 9*a* flowing in the annular duct 21 created in this way between the combustion chamber 3 and the chimney.

In a variant, the combustion chamber 3 may be suspended in the exhaust chimney 11 by suspension means 25, preferably provided in the cooler portions of the combustion chamber 3 and cooled by the cool air 9*a* flowing in the annular duct 21.

In another variant, the exhaust chimney 11, the combustion chamber 3, the heater body 5, and the air box 15 can be secured to a common support (23*a* or 23*b*) at an intermediate deck or at an upper deck.

It should be observed that these approaches make it possible to use mechanical interfaces 27 between the exhaust chimney 11 or the combustion chamber 3 and the support 23*a* or 23*b* that are simple in structure. These mechanical interfaces 27 remain at temperatures that are close to ambient temperature because of the flow of cool air 9*a* flowing in the annular duct 21.

In addition, the incinerator device 1 has a plurality of pipes or tubes 33 disposed above the combustion chamber 3 bringing in additional cool air 9*b* from the outside by a suction effect created by the cool air 9 coming from the fans 7*a*, 7*b*.

Thus, an additional fraction of dilution air is brought into the hot gas via the plurality of tubes 33 which are connected to the outside of the exhaust chimney 11. Since these tubes 33 are short in length, typically being about one-fifth of the diameter of the exhaust chimney 11, they present little head loss for the sucked-in air and can therefore deliver a very significant flow of additional dilution air, typically lying in the range 10% to 20%. This disposition can possibly make it possible to omit installing additional fans in association with the high portion of the combustion chamber 3, thereby simplifying the installation.

Furthermore, the incinerator device 1 may include a turbulator 35 for facilitating mixing of the combustion gas with the cool air. The turbulator 35 may be mounted on a fraction of the plurality of tubes 33. Advantageously, the turbulator 35 may be supported by some of the tubes 33 so that the cool air 9*b* sucked in thereby can be used for cooling it. There is thus no need to have recourse to thermal insulation or to make the turbulator 35 out of refractory materials that are expensive.

In order to reduce the size of the fans 7*a*, 7*b* for a given exhaust temperature at the outlet from the exhaust chimney 11, the incinerator device 1 may include at least a first water circuit 37 having at its end a first spray nozzle 39 received inside at least one of the tubes of the plurality of tubes 33. The first spray nozzle 39 injects water into the mixture of combustion gas and cool air in order to cool it by partial or complete evaporation.

It should be observed that this approach enables water to be injected into the middle of the hot gas while avoiding exposing the injection nozzles 39 to high temperatures since the nozzles are located inside cool air suction tubes 33, and thereby come into direct contact only with air at a temperature that is close to ambient. This can optionally make it possible to use sea water, while reducing any risk of salt being deposited, and of clogging or corrosion in the water circuits and the injection nozzles.

The incinerator device 1 may optionally include an additional duct 41 mounted around a top portion of the exhaust chimney 11, entraining an additional flow of ambient air by a suction effect into the plume of hot gas.

Under such circumstances, the incinerator device 1 may include a second water circuit 43 having at its end a second spray nozzle 45 received inside said additional duct 41 in order to obtain lower plume temperatures.

Thus, the cooling of the walls of the combustion chamber 3 is achieved mainly by forced convective heat exchange over the outside faces thereof, while the cooling of the hot gases is induced by the cool air ducts 33 in the hot flow, possibly followed by the injection via the water circuit 37, 43. The mixing of the additional cool air and the water with the hot gas is ensured by the turbulence that is created by the cool air and water injection ducts 29*a*, 29*b* and 37, 43, and also by the turbulator 35.

It should be observed that the pressure difference between the annular duct 21 and the inside of the combustion chamber 3 is very low, typically being of the order of 100 pascals (Pa), i.e. 1 millibar (mbar). Firstly the hot gases are mixed from the low portion of the combustion chamber 3 by feeding air through the air box with a mixture ratio of about "70". Secondly, the hot gases are mixed by the turbulence and by the additional supply of cool air created via the tubes or orifices 29*a*, 29*b*, 33 or the turbulator 35.

Thus, because the burner is fed in excess, from below, at a ratio of about 70, the mean temperature of the hot gas has a bottom level of about 700° C. By combining this effect with the cooling of the walls of the combustion chamber by the annular duct 21, the temperature of the hot gas is brought down to a bottom level of about 550° C., thus making it possible to use non-refractory materials for this chamber, such as stainless steel.

The heater body 5 further comprises one or more burners 47 which are ignited under the control of a flame detector system 49, e.g. including ultraviolet detector cells.

A diaphragm 51 is optionally placed level with the burner (s) 47 in order to optimize the distribution of air thereabout and in order to create turbulence for catching the flame.

The heater body 5 is also fed with gas in independent manner by a main circuit 53 presenting a high flow rate and by a secondary circuit 55 presenting a low flow rate. The main and secondary circuits 55 and 53 are fed by a gas line 57, e.g. of a ship (see FIG. 2). The flow of gas sent to the incinerator device 1 from the gas line 57 is regulated by a regulator valve 59.

Thus, the burner(s) 47 of the heater body 5 is/are fed from the gas line 57 via two branches corresponding to two different ranges of flow rates.

The main circuit or branch 53 is controlled by first and second valves 61 and 63 which are closed under the control of a pressure sensor or detector 65 in the event of the fan(s) 7*a*, 7*b* failing, or by the flame detector 49 in the event of the burner(s) 47 failing to ignite.

In contrast, the secondary circuit or branch 55 is controlled by third and fourth valves 67 and 69 which are closed under the control of the pressure detector 65 in the event of the fan(s) 7*a*, 7*b* failing.

The high-flow, main circuit or branch 53 is used in normal operation when the gas sent to the incinerator 1 is sufficiently rich in methane to enable it to be ignited by an ignitor 71 (e.g. electrical spark plugs), thereby leading to combustion and to the creation of a flame 31 that is detectable by the flame detector 49.

For greater safety, whenever the flame 31 is no longer detected by the flame detector 49, for any reason whatsoever, the first and second valves 61 and 63 are closed and a safety valve 73 is opened to exhaust the gas trapped between these two valves 61 and 63 to a vent.

Since the incinerator 1 must nevertheless be capable of treating a mixture of natural gas and methane that is not combustible, the device of the invention makes it possible, when said high flow rate main circuit 53 is closed, to use the secondary circuit 55 to deliver a flow of gas mixture to the burner 47, even if the gas mixture is not combustible. This gas mixture injected into the combustion chamber 3 is diluted with the air delivered by the fans 7*a*, 7*b* and the tubes 33 and the duct 41. This additional reduction in the methane content of the mixture makes it possible to guarantee that this methane content in the gas escaping from the exhaust chimney 11 is indeed below the range in which an explosion might occur.

Thus, when the incinerator device 1 is operating in this way, the ignitor 71 can be activated regularly in order to re-ignite the mixture should it ever become combustible again, for example on switching from a tank of the ship that is filled with inert gas to another tank that is filled with natural gas vapor. If the combustion continues, then the flame 31 can again be detected by the flame detector 49, thus allowing the first and second valves 61 and 63 of the main circuit 53 to be opened again, and enabling a greater rate of flow of gas from the tanks for treatment.

This makes it possible to ensure automatically that the mixture of natural gas and inert gas is treated either merely by dilution at a low flow rate, or else by combustion at a high flow rate, providing the mixture is sufficiently rich. This serves to optimize the length of time required for operations of making the tanks inert or of refilling them with gas.

When the incinerator device 1 is operating in dilution mode, safety relies on closing the third and fourth valves 67 and 69 in the event of the fans 7*a*, 7*b* failing and no longer guaranteeing that the mixture is diluted sufficiently. This safety can be controlled by the pressure sensor 65 which measures the head loss between the fans 7*a*, 7*b* and the combustion chamber 3 through the diaphragm 51 placed close to the burner 47.

The safety of the incinerator device 1 is thus guaranteed at low flow rate by closing the third and fourth valves 67 and 69 and opening another valve 75 for connection to the vent as soon as the pressure sensor 65 detects pressure that is too low, and thus a flow of air that is too low to dilute sufficiently the mixture of gas delivered to the incinerator 1, regardless of whether that mixture is sufficiently rich in methane to be capable of being burnt therein, or merely of being diluted.

Similarly, safety is guaranteed at high flow rate by closing the first and second valves 61 and 63 of the main circuit 53 and by opening the valve 73 leading to the event as soon as the flame detector 49 no longer detects a flame, which runs the risk of re-ignition taking place suddenly, or as soon as the pressure sensor 65 detects a failure of the fans 7*a*, 7*b* running the risk of the exhaust temperature being too high.

It should be observed that the maximum flow rate in the secondary circuit 55 can be controlled by a specific constriction or by selecting the sections of the third and fourth valves 67 and 69. It can thus be guaranteed that even under conditions of the gas mixture being at its maximum pressure at the inlet to the incinerator 1, the rate of dilution in the combustion chamber 3 is such that re-ignition of the gas mixture by the ignitor 71 will not be dangerous, in the event of the mixture becoming combustible again.

The secondary circuit 55 coupled with the ignitor 71 acts as a pilot flame which, once activated and detected by the flame detector 49, serves to ignite the main flame 31 fed by opening the main circuit 53 controlled by the valves 61 and 63.

Furthermore, in a slow diesel ship including a reliquefier, the secondary circuit 55 can be used to treat the nitrogen-rich vapor fraction that is not reliquefied and returned to the tank, where such treatment is by combustion and by dilution. In contrast, the main circuit 53 is activated only in the event of the reliquefier failing (or during transient operation thereof on starting or stopping) when the incinerator 1 needs to burn some or all of the vapor coming from the tanks of the ship.

Advantageously, the incinerator device 1 includes a buffer tank 81 put into communication either with the gas line 57 via fifth and sixth valves 83 and 85 in order to control its pressure, or with the heater body 5 via the third, fourth, and fifth valves 67, 69, and 83 in order to be depressurized. This makes it possible to damp transients in the flow rate of the gas that is to be treated by the incinerator 1.

The buffer tank 81 can be isolated by the valve 83 even though it is connected upstream from the valves 67 and 69. Furthermore, the buffer tank 81 can be coupled with the valve 85 placed between the main and secondary circuits 53 and 55. This arrangement makes it possible to use this buffer capacity, not between the minimum and maximum values of pressure in the gas line 57, but instead between the maximum pressure and a pressure that is slightly above the pressure in the combustion chamber 3.

In particular, for a ship using gas vapor for propulsion purposes, the gas flow rate under nominal conditions in the gas line 57 is adjusted by pressurizing and re-heater systems (not shown) provided for this purpose in order to satisfy the needs of the engines propelling the ship and causing the flow rate of gas for treatment by the incinerator 1 to be reduced to zero. In order to reduce the electricity consumption of the incinerator very considerably, it is therefore advantageous to be able to stop the fans 7*a* and 7*b* under nominal conditions of the system during which there is no excess gas vapor to be eliminated. Under such circumstances, in the event of a sudden change of conditions, or in the event of one or more of the propulsion engines of the ship stopping, it is necessary to be capable of absorbing the excess natural gas vapor in the gas line 57 in order to prevent its pressure rising, for the total length of time taken to put the fans 7*a* and 7*b* back into operation, for the pressure detector 65 to detect sufficient pressure to allow the secondary circuit 55 to be open, and subsequently for the flame detector 49 to detect the flame 31 and allow the main circuit 53 to be opened.

It should be observed that when the incinerator is inactive, with the fans 7*a*, 7*b* stopped and with the valves 61, 63, 67, and 69 closed, the buffer tank 81 is at a pressure that is close to atmospheric pressure.

However, when the gas pressure in the gas line 57 comes close to its upper limit, the fans 7*a*, 7*b* are started and the valves 59 and 85 are opened. Thus, a fraction of the gas present in the gas line 57 can then be absorbed by the buffer tank 81 with its pressure rising progressively to that of the gas line 57.

Once the fans 7*a*, 7*b* are up to a sufficient speed, an alarm controlled by the pressure sensor 65 is lifted and the valves 67 and 69 of the secondary circuit 55 can be opened and the ignitor 71 activated. If the gas is sufficiently rich in methane, it begins to burn and another alarm controlled by the flame detector 49 can also be lifted, thus enabling the main circuit 53 to be opened under the control of the valves 61 and 63.

The incinerator 1 can then operate at full power, depending on the flow rate of the gas for treatment in order to maintain the pressure in the gas line 57 in its nominal range. The valve 85 can then be closed, enabling the tank 81 to be isolated from the gas line 57, while keeping it in communication with the burner 57 via the secondary circuit 55, with the valves 67, 69, and 83 being kept open.

Insofar as the technology for the burner 57 is selected appropriately, it can thus operate with very low head loss, typically less than 10 kPa. Under such circumstances, the gas absorbed in the buffer tank 81 can be exhausted to the burner 47 until the tank reaches a pressure very close to that in the combustion chamber 3, which is itself close to atmospheric pressure. When the pressure in the buffer tank 81 is brought to this value, the vales 67, 69, and 83 can be closed and the buffer tank 81 can be closed off, ready to be used again in order to accommodate a pressure transient in the gas line 57.

Figure 3:
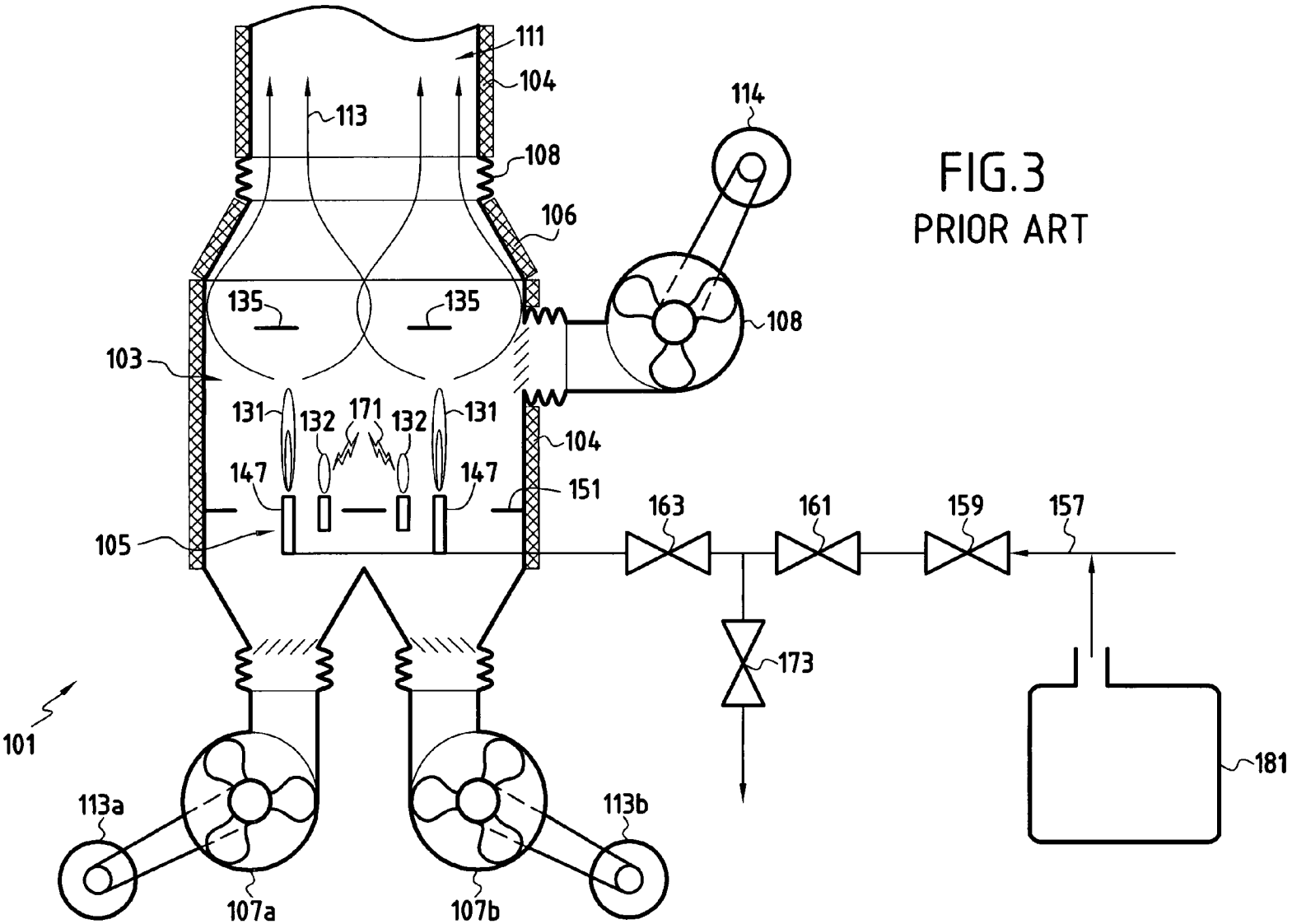
FIG.3 PRIOR ART
FIG. 3 is a highly diagrammatic view of a prior art gas incinerator device.

It should be observed that the operating pressure range of the buffer tank 81 which lies between the nominal maximum pressure in the gas line 57 and atmospheric pressure is much greater than the range of the prior art tank (see FIG. 3) which lies merely between the minimum and maximum pressures of the gas line.

Typically, the nominal pressure in the gas line 57 varies over the range 0.6 megapascals (MPa) and 0.8 MPa, whereas the pressure in the buffer tank 81 can vary between 0.8 MPa and atmospheric pressure. It can thus be seen that in order to absorb a given quantity of gas, the volume of the buffer tank 81 is about one-fourth the volume of a prior art tank, which presents an advantage that is very significant in terms of cost and size.

It should be observed that in order to avoid any risk of an explosive mixture in the secondary and primary circuits 55 and 53 or in the buffer tank 81, it is possible to fit devices such as check valves 87 or inert gas injection circuits (not shown), e.g. for injecting nitrogen.

When the pressure transition requiring the excess gas in the gas line 57 to be burnt off has passed, the valves 67, 69, and 57 can be closed and the fans 7*a* and 7*b* can be switched off again. It is thus possible with a buffer tank 81 of small size to accommodate transients in the burning of the gas while minimizing the amount of electricity consumed by the fans 7*a*, 7*b*.

Figure 2:
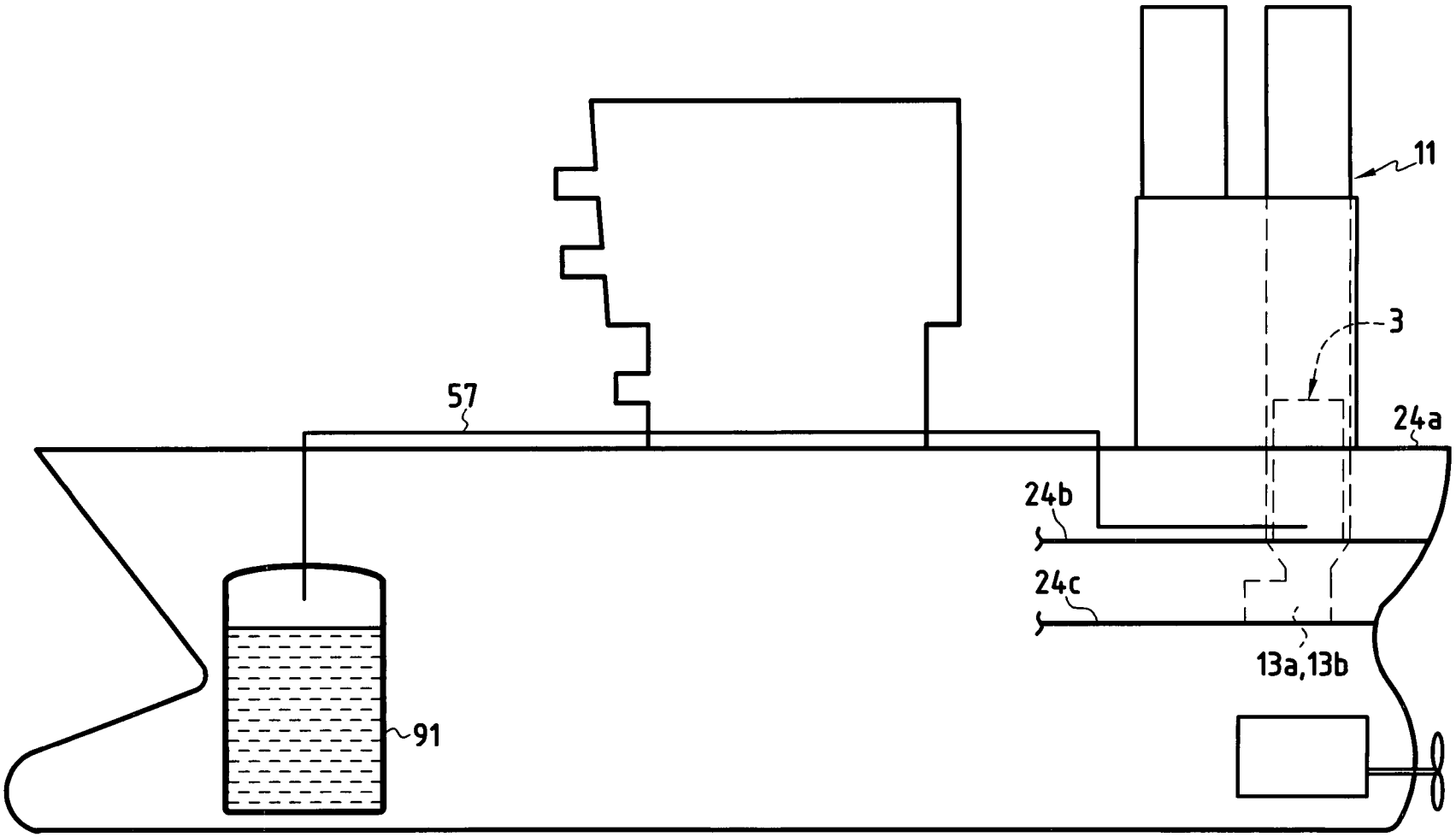
FIG. 2 is a highly diagrammatic view of a ship including the FIG. 1 incinerator device.

FIG. 2 is a highly diagrammatic view of a tanker ship having liquefied gas tanks 91 and including an incinerator device of FIG. 1, for burning vapor escaping from the tanks.

In this example, the exhaust chimney 11 is mounted on the top deck 24*a* and the fans 7*a* and 7*b* are mounted on the bottom deck 24*c* of the ship. In contrast, the combustion chamber 3, the heater body 5, and the air box 15 are mounted on the intermediate deck 24*b* of the ship.

It should be observed that the incinerator device can also be used in a gas terminal.

What is claimed is:

1. A gas incinerator device comprising:

a combustion chamber having a heater body producing combustion gas, wherein the heater body is fed with gas independently by a main circuit having first and second valves, to provide a high flow rate, and by a secondary circuit having third and fourth valves, to provide a low flow rate, the main and secondary circuits being connected to a gas line;

at least one fan feeding the heater body with cool air to ensure combustion;

an exhaust chimney for exhausting the mixture formed by the combustion gas and the cool air; and a buffer tank that is selectively in communication either with the gas line via fifth and sixth valves, to control a pressure therein, or with the heater body via third, fourth, and fifth valves in order to be depressurized, wherein the first and second valves of the main circuit can be closed by a pressure detector, in the event of said at least one fan failing, or can be closed by a flame detector, in the event of failure to ignite, the third and fourth valves of the secondary circuit can be closed by the pressure detector, in the event of said at least one fan failing, and wherein the combustion chamber is mounted in the exhaust chimney in such a manner as to leave an annular duct between the combustion chamber and the exhaust chimney to pass a flow of combustion cool air and/or of cooling air coming from said at least one fan, said combustion chamber having a plurality of injection orifices and/or tubes enabling a fraction of the cool air flowing in the annular duct to be injected therein.

2. A device according to claim 1, wherein the exhaust chimney is secured to a first support and the combustion chamber is secured to a second support.

3. A device according to claim 1, wherein the exhaust chimney is secured to a first support and the combustion chamber is suspended in the exhaust chimney by suspension means cooled by the air flowing in the annular duct.

4. A device according to claim 1, including a plurality of tubes disposed above the combustion chamber and delivering additional cool air from the outside by a suction effect created by the cool air coming from said at least one fan.

5. A device according to claim 4, including a turbulator facilitating mixing of the combustion gas and the cool air, said turbulator being mounted on a fraction of said plurality of tubes.

6. A device according to claim 4, including at least a first water circuit having at its end a first spray nozzle received inside at least one tube of said plurality of tubes, the first spray nozzle injecting water into the mixture formed by the combustion gas and the cool air.

7. A device according to claim 1, including an additional duct mounted around a top portion of the exhaust chimney and entraining an additional flow of ambient air by a suction effect.

8. A device according to claim 7, including at least one second water circuit having at its end a second spray nozzle received inside said additional duct.

9. A tanker ship having liquefied gas tanks, the ship including a gas incinerator device according to claim 1 which comprises a combustion chamber having a heater body producing combustion gas, at least one fan feeding the heater body with cool air to ensure combustion, and an exhaust chimney for exhausting the mixture formed by the combustion gas and the cool air, wherein the combustion chamber is mounted in the exhaust chimney 5 in such a manner as to leave an annular duct between the combustion chamber and the exhaust chimney to pass a flow of combustion cool air and/or of cooling air coming from said at least one fan, said combustion chamber having a plurality of injection orifices and/or tubes enabling a fraction of the cool air flowing in the annular duct to be injected therein.

10. A gas terminal, including a gas incinerator device according to claim 1 which comprises a combustion chamber having a heater body producing combustion gas, at least one fan feeding the heater body with cool air to ensure combustion, and an exhaust chimney for exhausting the mixture formed by the combustion gas and the cool air, wherein the combustion chamber is mounted in the exhaust chimney in such a manner as to leave an annular duct between the combustion chamber and the exhaust chimney to pass a flow of combustion cool air and/or of cooling air coming from said at least one fan, said combustion chamber having a plurality of injection orifices and/or tubes enabling a fraction of the cool air flowing in the annular duct to be injected therein.

11. A gas incinerator device comprising:

a combustion chamber having a heater body producing combustion gas, wherein the heater body is fed with gas independently by a main circuit having first and second valves, to provide a high flow rate, and by a secondary circuit having third and fourth valves, to provide a low flow rate, the main and secondary circuits being connected to a gas line;

at least one fan feeding the heater body with cool air to ensure combustion;

an exhaust chimney for exhausting a mixture formed of the combustion gas and the cool air and having the combustion chamber mounted therein so that the exhaust chimney extends above the combustion chamber;

an annular duct between the exhaust chimney and the combustion chamber mounted therein, to pass a flow of at least one of the mixture of combustion gas and cool air and cool air coming from said at least one fan, said combustion chamber having a plurality of injection orifices between the chamber and the annular duct enabling a fraction of the cool air flowing in the annular duct to be injected into the combustion chamber;

a buffer tank that is selectively in communication either with the gas line via fifth and sixth valves, to control a pressure therein, or with the heater body via third, fourth, and fifth valves in order to be depressurized, wherein the first and second valves of the main circuit can be closed by a pressure detector, in the event of said at least one fan failing, or can be closed by a flame detector, in the event of failure to ignite, the third and fourth valves of the secondary circuit can be closed by the pressure detector, in the event of said at least one fan failing, and a plurality of tubes disposed above the combustion chamber and connected to an outside space of the exhaust chimney, to deliver additional cool air from the outside space by a suction effect created by cool air coming from said at least one fan.

12. A device according to claim 11, including a least a water circuit having at its end a spray nozzle received inside at least one tube of said plurality of tubes, the spray nozzle injecting water into the mixture formed by the combustion gas and the cool air.

* * * * *